US006044872A

United States Patent [19]

Stephens

[11] Patent Number: 6,044,872

[45] Date of Patent: Apr. 4, 2000

[54] FENCE CLIP INSTALLER

[76] Inventor: Donald R. Stephens, Rte. 1 - Box 20, Haines, Oreg. 98733

[21] Appl. No.: 09/169,441

[22] Filed: Oct. 9, 1998

Related U.S. Application Data

[60] Provisional application No. 60/061,654, Oct. 10, 1997.

[51] Int. Cl.[7] ..... B21F 15/06

[52] U.S. Cl. ..... 140/57; 140/49

[58] Field of Search ..... 140/49, 53, 54, 140/57, 93 A, 117, 118, 119

[56] References Cited

U.S. PATENT DOCUMENTS

| | | | |
|---|---|---|---|
| 1,094,588 | 4/1914 | O'Brien . | |
| 1,111,114 | 9/1914 | Weber . | |
| 1,111,115 | 9/1914 | Weber . | |
| 1,612,870 | 1/1927 | Leschhorn . | |
| 1,807,170 | 5/1931 | Peterson . | |
| 2,622,634 | 12/1952 | Hill | 140/49 |
| 2,987,729 | 6/1961 | Taynton | 1/220 |
| 3,786,841 | 1/1974 | Albrecht et al. | 140/119 |
| 4,087,034 | 5/1978 | Kikkawa et al. | 227/90 |
| 4,194,666 | 3/1980 | Spehrley, Jr. et al. | 227/155 |
| 4,319,706 | 3/1982 | Halstead | 227/126 |
| 4,378,085 | 3/1983 | McVeigh | 227/79 |
| 4,424,929 | 1/1984 | Weis | 227/32 |
| 4,500,024 | 2/1985 | DiGiovanni et al. | 227/19 |
| 4,527,725 | 7/1985 | Foslien | 227/19 |
| 4,546,528 | 10/1985 | Langas | 29/243.56 |
| 4,546,910 | 10/1985 | Logtens | 227/155 |
| 4,565,313 | 1/1986 | Buck et al. | 227/131 |
| 4,571,805 | 2/1986 | Niedecker | 29/243.56 |
| 4,593,846 | 6/1986 | Evertz et al. | 227/130 |
| 4,593,847 | 6/1986 | Hagemann | 227/155 |
| 4,709,842 | 12/1987 | Westerlund | 227/120 |
| 4,729,164 | 3/1988 | Steeves | 29/809 |
| 4,805,824 | 2/1989 | Erickson | 227/120 |
| 4,923,107 | 5/1990 | Echevarria | 227/120 |
| 5,004,142 | 4/1991 | Olesen | 227/155 |
| 5,025,968 | 6/1991 | Nasiatka | 227/8 |
| 5,054,678 | 10/1991 | Nasiatka | 227/8 |
| 5,147,080 | 9/1992 | Assink et al. | 227/82 |
| 5,231,748 | 8/1993 | Knudson et al. | 29/243.517 |
| 5,497,932 | 3/1996 | Brewer et al. | 227/132 |
| 5,516,025 | 5/1996 | Eriksson | 227/155 |
| 5,634,582 | 6/1997 | Morrison, Jr. et al. | 227/109 |

*Primary Examiner*—Lowell A. Larson
*Attorney, Agent, or Firm*—Ken J. Pedersen; Barbara S. Pedersen

[57] ABSTRACT

Embodiments of a fence clip installing tool and methods of using it are described. The preferred tool uses a stack of connected fence clips which are loaded in advance for semi-automatic multiple clip installations. Upon actuation, the tool places the simple, pre-shaped clip partially around the fence post, and then bends the clip ends around the wire that runs through the tool and laterally past the fence post. Thus, the clip extends around the back and two sides of the post and surrounds and grips the wire tightly on either side of the post to hold it securely against the front side of the post. The tool quickens the process of clip installation, lessens handling of clips, and results in more uniform installation, with the two clip ends extending in parallel vertical planes around the wire on either side of the post.

3 Claims, 8 Drawing Sheets

PRIOR ART CLIP

FENCE CLIP INSTALLER

This application is a continuation-in-part application which claims priority of and serves as a conversion of pending U.S. Provisional Patent Application Ser. No. 60/061,654, filed Oct. 10, 1997, entitled "Fence Clip Installer", the disclosure of which is herein incorporated by reference.

BACKGROUND OF THE INVENTION

1. Field of the Invention

This invention relates, in general, to an apparatus and method for securing fencing wire to a fence post. More specifically, the invention relates to a device for quickly and conveniently installing clips that attach wire strands onto metal fencing posts on farms, ranches, and industrial sites.

2. Related Art

Many agricultural and industrial locations currently use fencing that comprises metal posts for upright members and wire strung horizontally between, and secured to, the posts at one or more levels above the ground. Currently, the standard means for attaching the fence wire to the metals post is a generally U-shaped wire clip 3 with each of its ends curved out in a circular or semi-circular shape. These clips 3 are typically a thick wire of about 6 gauge that is bent by the manufacturer into the U with its "curled" ends 5 lying in generally the same plane as the main body 7 of the "U", as shown in the "prior art clip" of FIG. 10. The standard clip 3 is generally smoothly curved rather than bent at an angle and is about 3 inches long and about 3 inches wide at its widest point. The clips 3 are packaged loose and unattached to each other in boxes or bags, where many of the clips becoming tangled together due to their shape.

A person stringing the fence wire typically carries a bag of dozens or hundreds of these clips with him/her to the fencing site and, each time he needs one or each time his handful of clips runs out, he reaches into the bag to untangle a clip or clips from the jumble. While holding the wire in place against the post, he pushes the individual clip 3 horizontally around the fence post above the wire. He then slips a long nail or other elongated member through one curled end 5 of the clip to engage the end of the clip and then manually twists the end down around the wire on one side of the post, and crimps the clip end onto the wire with a pliers. He then uses the nail to engage the other curled end 5 of the clip and, likewise, to twist it down around the wire on the other side of the post and crimp it with a pliers. He must use considerable strength to twist each end down to crimp the clip around the wire, to pull the clip snug against the post, thus securing the wire tightly to the post to prevent the clip and wire from falling down the post. Most standard metal posts include protrusions running down one side (as in the front of the post in FIG. 1) that form notches, and these notches act as ledges upon which the wire may rest to help prevent it from sliding down the post during installation and after installation Still, the person installing the clip must tighten the clips enough to keep the wire from moving out of the post notches and preferably enough to prevent lateral movement of the wire through the clip after installation.

The standard wire and clip installation procedure is a clumsy and time-consuming procedure, and, therefore, an inefficient and costly procedure. Along a one-mile stretch of fence, a typical 5-wire fence will require about 1650 clips. The person installing the fence must first pound in a post and wrestle with a box or bag of tangled clips. He/she must use strength and manual dexterity to properly position and pull taught the wire, to properly position the clip relative to the post and wire, and then to tighten the clip ends around the wire. This procedure requires a great deal of man-power and is considered a tedious and frustrating job. There is a need, therefore, for an improved technique and apparatus for securing fence wire to the commonly-used metal fence posts.

SUMMARY OF THE INVENTION

An object of the present invention is to provide a quicker and less awkward method for installing fence when using conventional metal fence posts. Another object is to provide an installation tool that gives quick, reproducible, consistent, and reliable results. Another object is to provide an improved clip design and to eliminate the need to untangle individual clips from a mass of jumbled, tangled clips.

The present invention comprises a device for installing clips around a post and wire. The device comprises a tool which holds and manipulates a plurality of clips in an organized fashion in the proximity of the vertical post and transverse wire. The invented tool installs the clip semi-automatically by forcing the clip around the post and then around the wire on both sides of the post. This is preferably done with a movement of one or more handles, or by other convenient, reproducible, and comfortable movement of an actuator such as one or more handles or triggers.

The device is preferably hand-held and may be loaded with a stack of clips that are aligned and temporarily connected together to create a type of "clip cartridge". The device is then used to install that number of clips in the cartridge quickly and consistently without reloading.

The tool has a mechanism to move one clip at a time horizontally toward the post into a "straddling" position, around the post and adjacent to the wire to be fastened. The tool also has a mechanism to then simultaneously bend both ends of the clip down from the plane of the clip to tighten them around the wire. Preferably, these two mechanisms are accomplished by one or more easily-gripped actuating handles manipulated by the user. This way, the tool installs the clip securely around post and wire in one or two smooth operations, without the need for the user to contact or manipulate the clips with his hands after the initial loading of a stack of clips into the tool. The invented tool may also include a system for bracing the tool against the post and/or wire, which may include closing or tightening part of the tool around the post.

DESCRIPTION OF THE PREFERRED EMBODIMENTS

Referring to FIGS. 1–9, there is shown one, but not the only, embodiment of the invented clip installation tool 10, herein also called "the tool" or "the installer", and the method of using the tool. Although the preferred embodiment at the time of filing is herein described, the invention may be altered for manufacturing efficiency and economy and still be within the scope and spirit of the invention.

Figure 1:
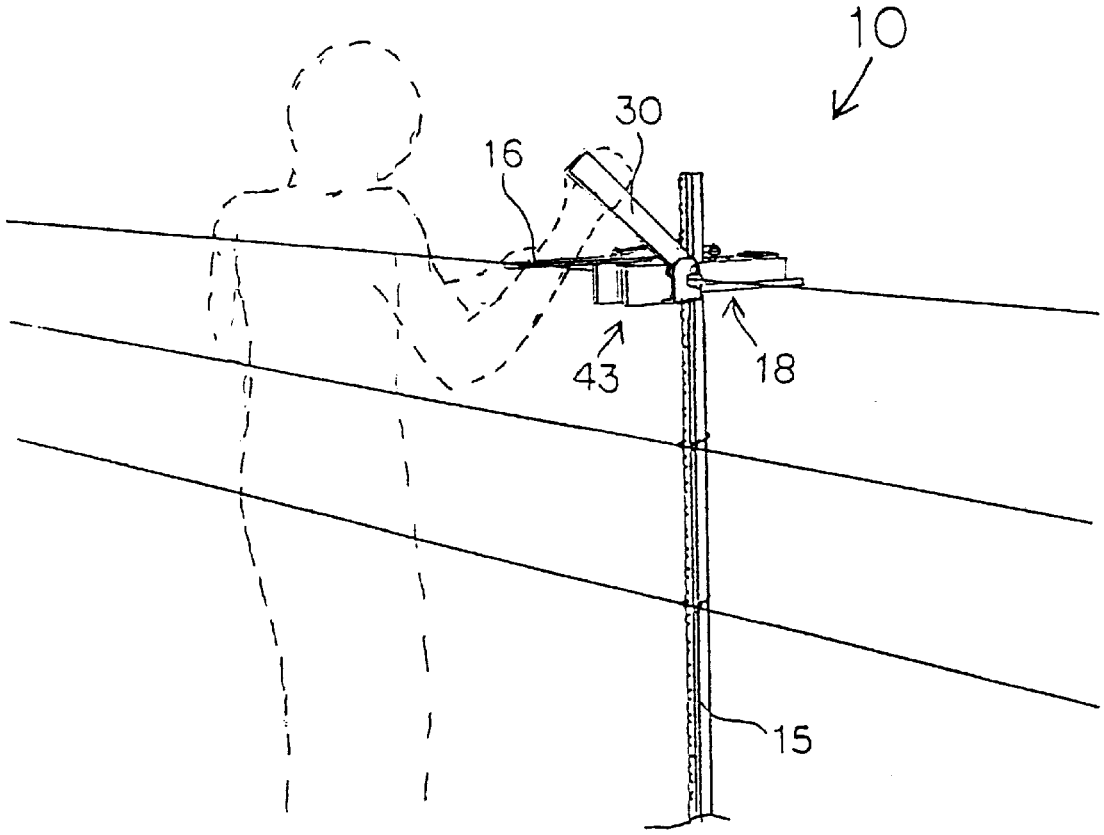
FIG. 1 is a perspective view of one embodiment of the invented clip installing tool and method, with the tool rear assembly in the back position to open the tool for installation around the fence post.
Figure 2:
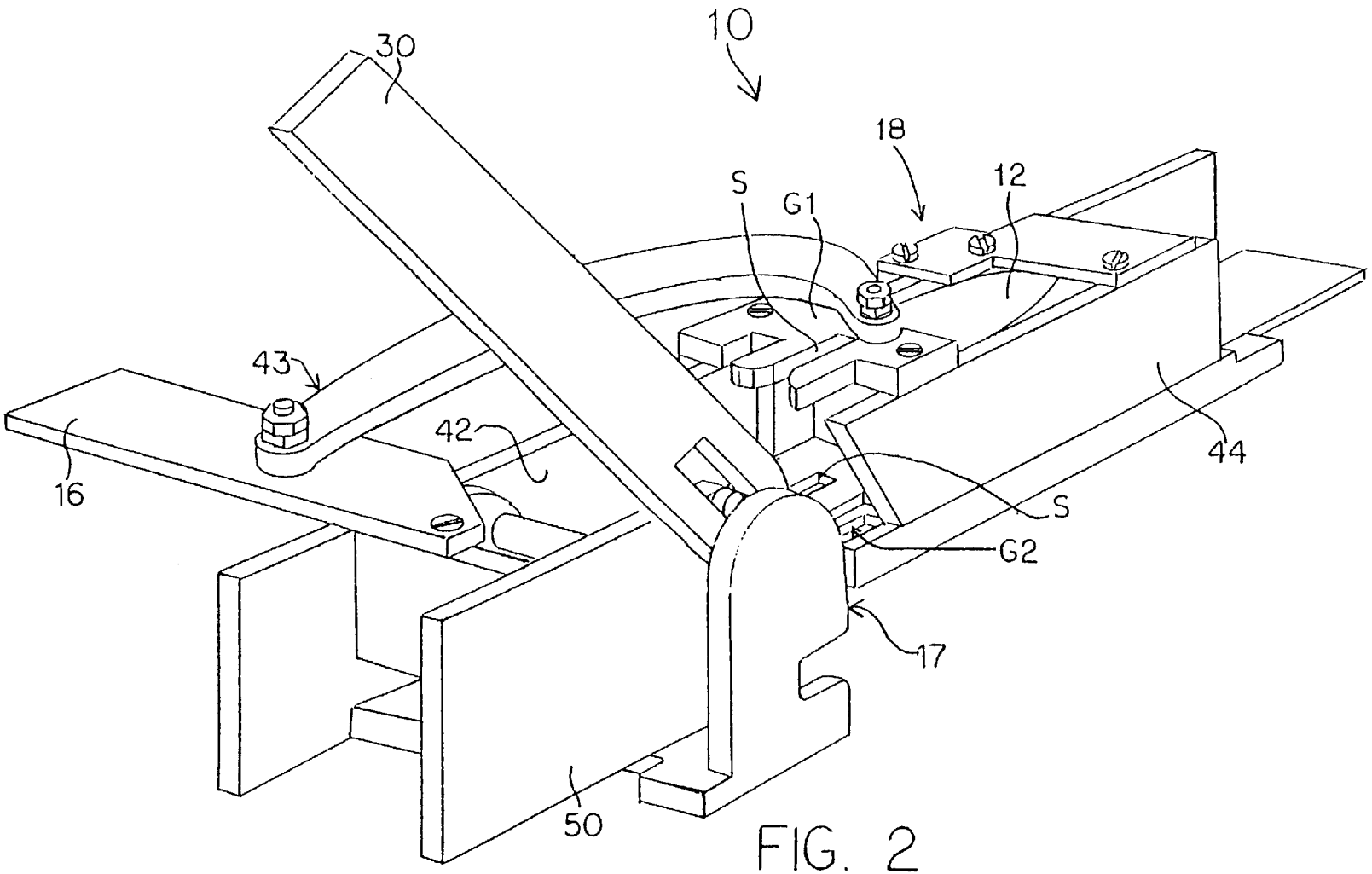
FIG. 2 is a perspective view of the invented tool of FIG. 1.

FIG. 1 suggests how a user may stand comfortably with the tool in his hand, repeatedly operating the tool in a smooth and efficient fashion to install clips at several levels on the post. Before clip installation, the user inserts a stack of clips 14 into the tool. The tool 10 has a receiving cavity 12 or other means for receiving the stack of connected clips 14. The clips 14 lie horizontally in the cavity 12 with the ends pointing forward, which is designated as the left side of FIGS. 1–5.

The user places the tool 10 around the metal fence post 15, through a side opening 17 of about 3–4 inches that allows the tool to lie in a horizontal plane, generally perpendicular to the post, and surround the post on three sides. After placing the tool 10 around the post 15, the tool 10 is positioned so that wire-receiving brackets 19 on each side of the tool receive the single wire or multi-strand wire 21 as it runs laterally and horizontally through the brackets 19.

Figure 3:
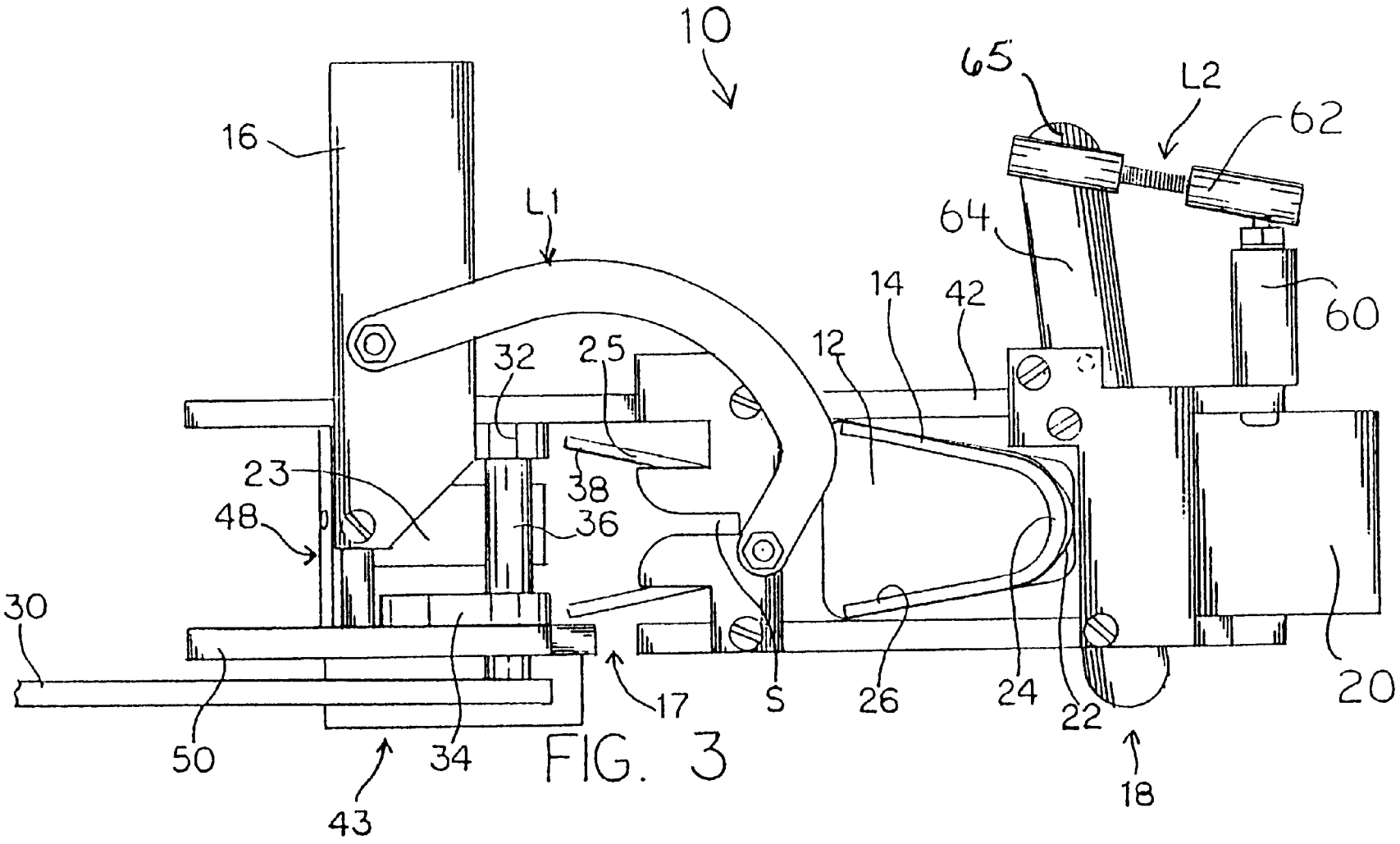
FIG. 3 is a top view of the tool of FIG. 1, shown with a stack of clips inserted into the tool, and one clip pushed forward as it would be around a post, prior to crimping.
Figure 4:
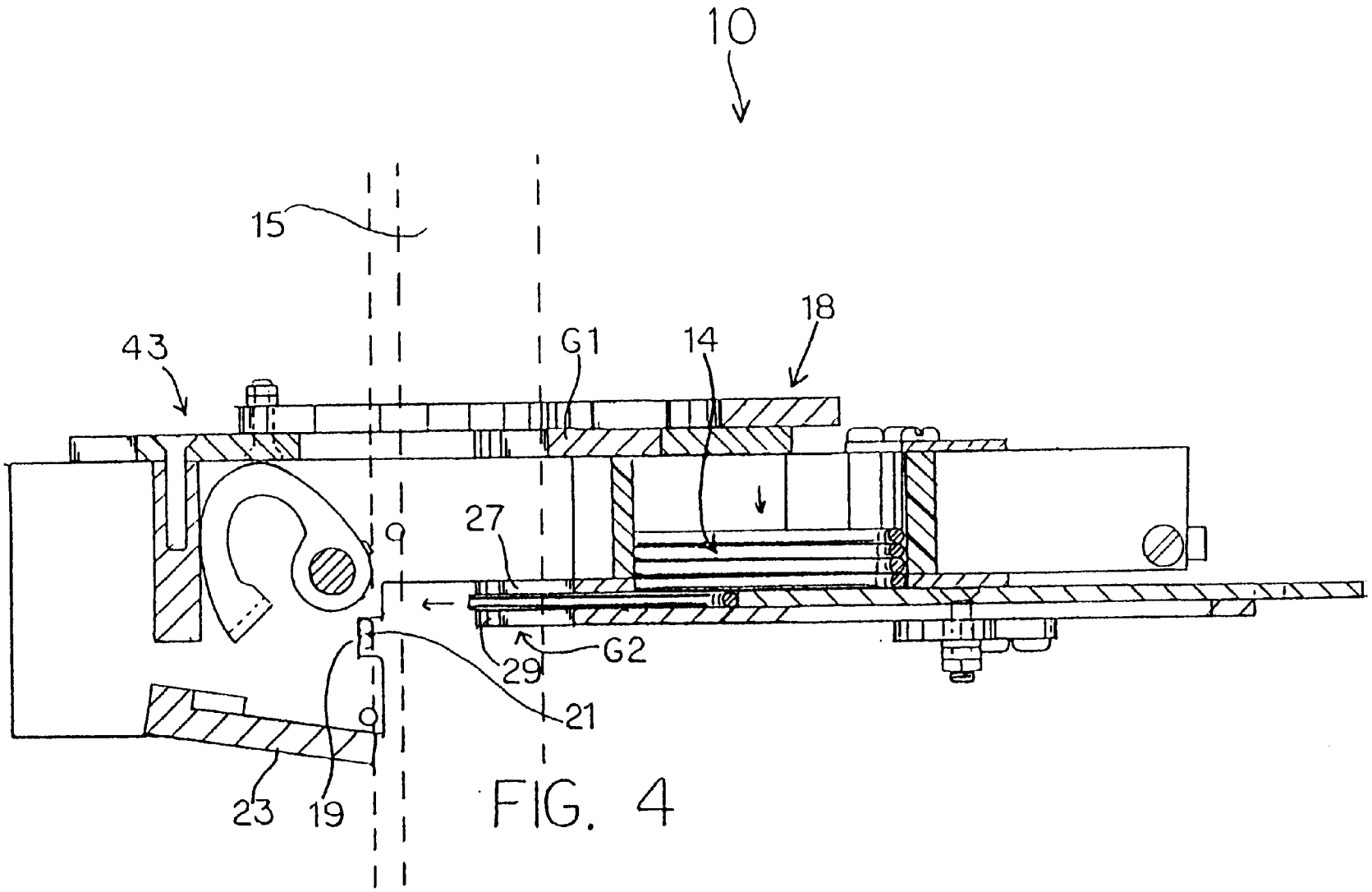
FIG. 4 is a cross-sectional side view of the tool of FIG. 1, with an arrow showing the forward movement of the bottom clip around the dashed-line fence post, and an arrow showing the downward movement that the stack of clips is to take after the bottom clip is fully forward.

The user then pulls a first handle, "slide" handle 16 which connects to the rear assembly via first lever system L1, in order to pull the rear assembly 18 forward towards him as indicated by FIGS. 3 and 4. This rear assembly 18 slides forward on the side wall 42 and has two main functions: 1) to close the tool opening 17 relative to its fully opened position in order to grip the post and thus brace the tool against the post, and 2) to move the clip appropriately around the post. The handle 16 and rear assembly 18 accomplish these two above-listed functions as described below.

The rear assembly 18 comprises upper and lower guide assemblies (G1 and G2) which come forward, when the handle 16 is pulled, to receive the rear, V-shaped side of the post in the slots (S) at the front of the guide assemblies, thus gripping the post between the guide assemblies and the support plate 23. The lower guide assembly (G2) comprises an upper plate 27 and a lower plate 29, which are parallel to each other and provide a horizontal space only slightly larger than the thickness of the preferred clip (about ⅓ centimeter) and only slightly wider than the width of the clip. The upper plate 27 has an aperture approximately the size and shape of the clip at the clip's outer perimeter, so that the stack of clips in the clip cavity 12 can rest on the lower plate 29, with the bottom clip sitting in the aperture and on the lower plate 29. Also, there may be a cavity wall 26 with an interior surface slightly larger than, but in the shape of, the outer perimeter of the clip stack, for providing a close-fitting cavity fitting the shape of the clips. Thus, the cavity 12 supports the clip stack, maintains proper orientation of the clips and prevents premature detachment of the clips from each other.

Between the lower and upper plates and behind the bottom clip is the slide plate 20 which is used to force the bottom clip forward. Slide plate 20 has a curved front edge 22 which receives the back end 24 of the bottom clip of the stack. Slide plate 20 is adapted to slide forward and backward between the lower plate and upper plate, guided by the sidewalls 42 and 44. Slide plate 20 may be controlled by a lever assembly L2. The lever assembly L2, which is summarized below, may connect to the lower plate by being bolted to the slide plate through a longitudinal slot in the lower plate.

In use, as the handle 16 is pulled forward, the first lever system L1 pulls the rear assembly 18 forward relative to the wall 42 and relative to the front assembly 43, closing up the opening 17 so that the post is gripped between the support plate and the slots of the guide assemblies, or at least so that the tool is stabilized/braced on the post to prevent tilting and wobbling. Simultaneously, the second lever system L2, which extends between the rear of the wall 42 and the slide plate 20, moves the slide plate 20 forward relative to the moving guide assemblies. This action of the slide plate detaches the bottom clip 25 from the stack of clips, leaving the remainder of clips intact and behind in their resting place on top of the upper plate. Lever assembly L2 comprises generally members 60 and 62 extending from the sidewall 42 to member 64. Member 64 pivots at a pivot point on the bottom of the rear assembly 18. Between the end 65 of the member 64 and the pivot point, the member 64 connects to the slide plate 20 near the proximal end of the slide plate. This way, when rear assembly 18 moves forward, member 64 pivots to push the slide plate 20 forward. The forward movement of the slide plate 20 relative to the guide assemblies, is controlled by the lever assembly L1 and L2 configuration and occurs at a rate and distance that pushes the bottom clip 25 around the post at about the same instant that the post is gripped.

Figure 5:
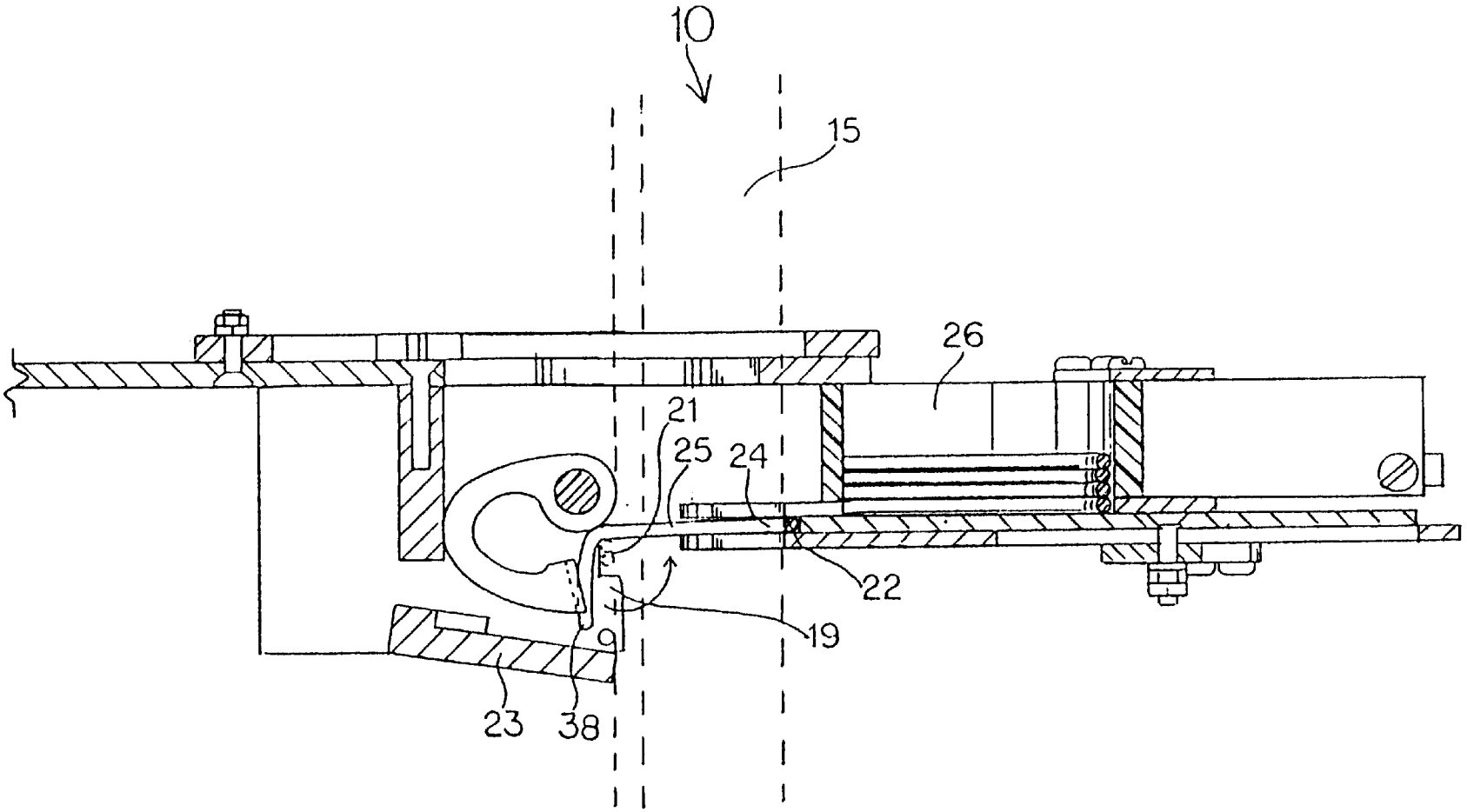
FIG. 5 is a cross-sectional side view of the tool of FIG. 4, with the crimping arm pivoting downward to push the clip end around the wire, herein shown as a two-strand wire.
Figure 6:
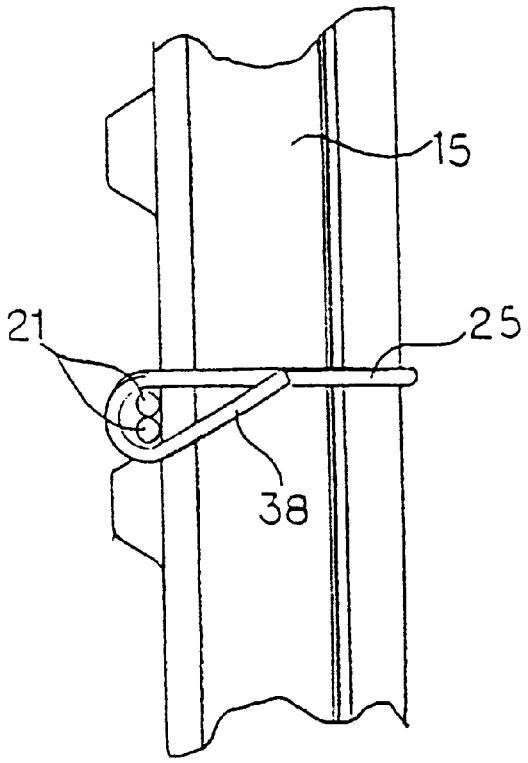
FIGS. 6 and 7 show two progressive positions of the crimped clip end around the wire, relative to the fence post, with FIG. 6 showing further rotation of the clip end for the tighter, preferred crimping of the wire.
Figure 7:
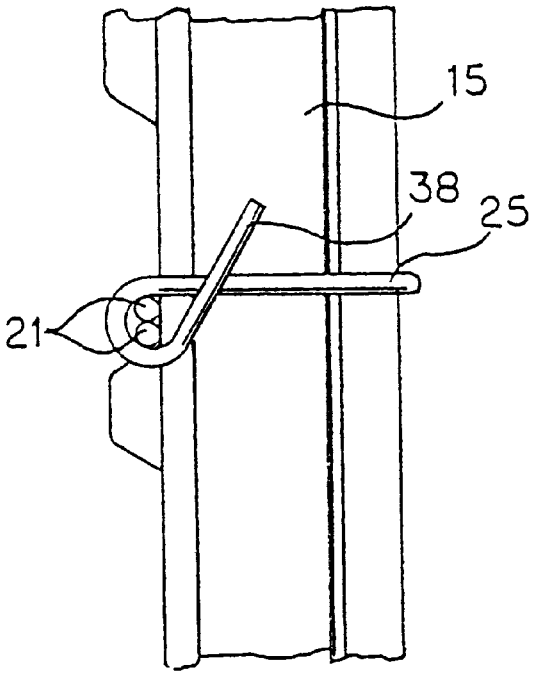
Figure 8:
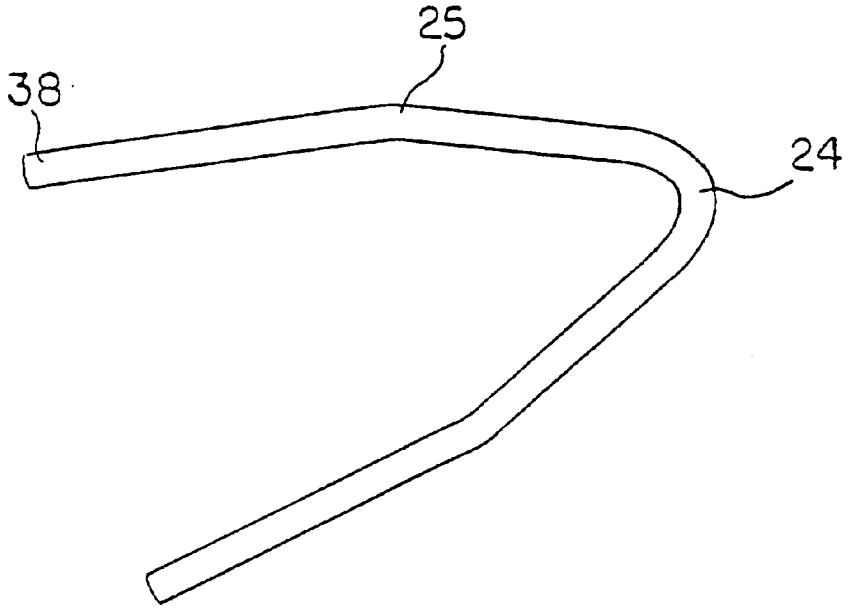
FIG. 8 is a perspective view of a single clip of the invention, as yet unattached from other clips.

Once the clip is pushed into place around the post, the user then pulls the second handle, the "crimping" handle 30, which actuates two crimping arms 32, 34, one of which is on each side of the tool and hence on each side of the fence post. FIGS. 3 and 5 show how both arms 32, 34 may pivot on a single axle 36, and how the arms pivot downward and backward (right in FIGS. 3 and 5) to contact the clip ends to force the clip ends 38 also down and backward. Thus, the clip ends curve or rotate counter-clockwise in FIG. 5 around the wire. Of particular importance in this invention is that this crimping or "pivoting" means forces the clip ends, which are otherwise generally straight portions of the clip, down out of the generally horizontal plane of the uncrimped clip and the main body of the clip. The crimping means forces the clip ends to pivot backward in a generally vertical plane, that is, generally perpendicular to the plane of the main body of the clip and generally parallel but laterally offset from the longitudinal axis of the clip. As shown in FIGS. 6 and 7, the arms pivot far enough to push the clip end at least close to the horizontal main body of the clip, that is, about 180 degrees. Preferably, the clip end is pushed even further to the position in FIG. 7, that is, greater than 180 degrees, and preferably about 225 degrees.

When the clip is completely installed, the user may let go of the handle 30, which returns it and the crimping arms by spring action to their original position. Then, he may return handle 16 to its original position, which re-widens the opening 17 by moving the rear assembly and slide plate backward away from the post. The tool 10 may then be moved sideways off the post and be moved to another position on the post or to the next post for repetition of the procedure.

Thus, two handles 16 and 30 actuate the two main functions of the tool 10: a) the sliding function, which requires a means for placing the clip around the fence post with the clip end extending forward past the post far enough to eventually extend around the wire or wires; and b) the crimping function, which requires means for forcing the clip ends around the wires. The crimping function preferably forces the clip ends tightly around the wire, frictionally engaging the wire on two or more sides. The sliding function preferably holds the back and/or sides of the clip snug against the post, so that there is little or no slack in the clip around the post once the crimping action to done. As described earlier in this document, the handle or handles may also serve to actuate means for gripping, closing around, or otherwise bracing the tool against the post and/or wire.

The preferred embodiment utilizes two separate handles and assemblies for performing the two preferred functions of the tool, with the sliding handle also serving to cause the gripping action around the post. However, alternatively, the inventor envisions that the tool may be made with one handle or actuator that causes both the insertion and crimping actions in sequence. This and other modifications may be made as deemed appropriate. Optionally, a more automatic actuating means may be used, such as push-button, battery-powered or other electrically-powered mechanisms, but such options are expected to add weight, limit portability, or limit the length of time the user may be in the field or lot before electric recharging.

The currently-preferred tool structure is shown to include side wall 42, which acts as a guide bar on which the rear assemblies slides, and which extends forward along the length of the tool to provide support structure for the rear assembly and also for the front assembly, that is, the pivoting mechanism with the crimping arms. A transverse structure 48 connects wall 42 to partial wall 50 which forms the opposite side support structure for the other pivoting crimping arm. Thus, the separation between the shorter walls 44 and 50 provides for the variable opening 17 which receives the fence post.

Figure 9:
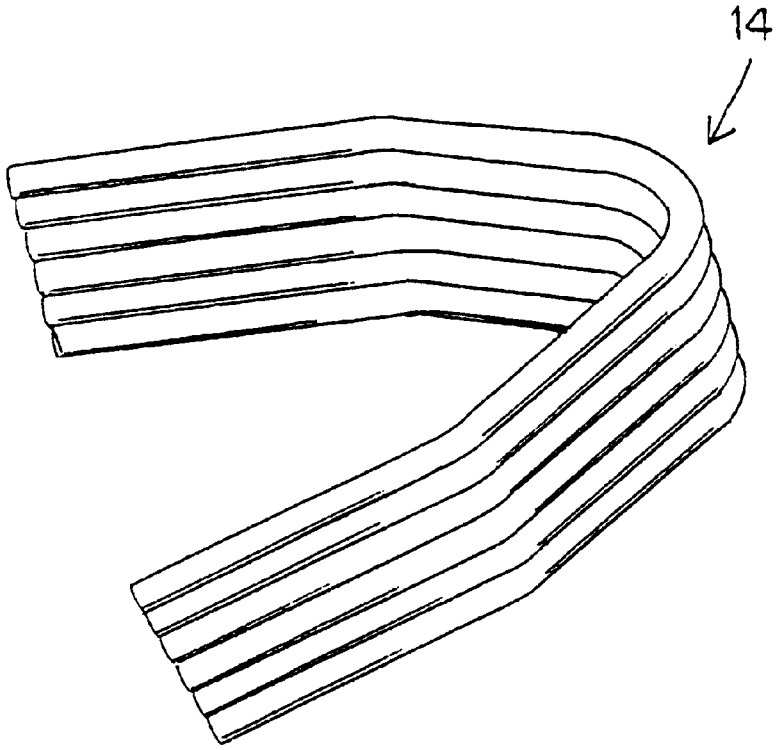
FIG. 9 is a perspective view of a plurality of the clips of FIG. 8, connected together by an appropriate temporary adhesive for creating a stack of clips.
Figure 10:
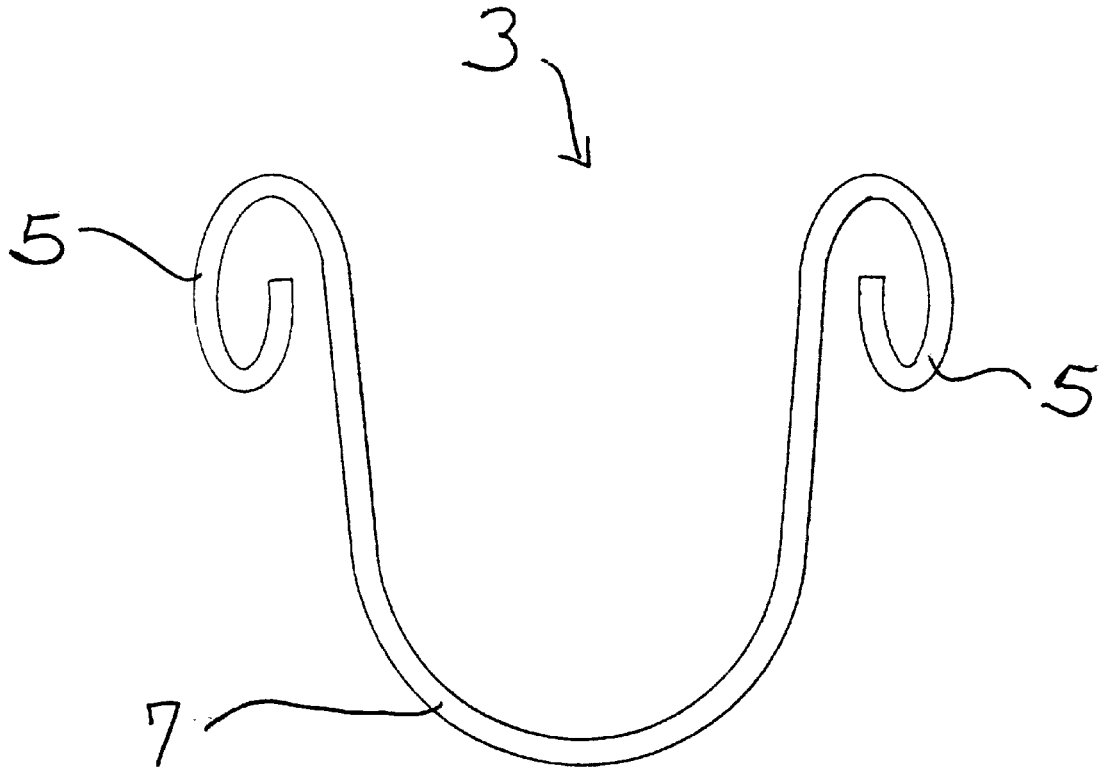
FIG. 10 is a top view of a prior art clip.

In FIG. 9, the preferred invented clip system is shown. This clip system comprises a rigid, U-shaped or almost V-shaped clip with generally straight ends. The clips are stacked in parallel planes on top of each other and an appropriate adhesive is used to connect together part or all of the top and bottom surfaces of the adjacent clips. The adhesive or other connecting means may be selected from conventional materials that may temporarily connect the clips until the sliding means pushes or otherwise forces one clip away from the others. This connection allows simpler, untangled storage and handling of the clips, and allows the user to easily count the number of clips he is starting with and the number he has installed. Storage of the stacks of clips may be done in rows of stacks or nested rows of stacks.

With this tool and clip stack or "cartridge" system, the user may insert a stack of clips and quickly install them, in effect, moving up or down the fence post quickly to attach each horizontal wire strand, and then quickly move to the next post. With the invention, the action of fence clip installation assumes a more quick and systematic motion, saving time and preventing frustration. The tool may be made of durable metal, plastic, and other materials that can withstand wear and weather for many years of service. The moving parts may be made with conventional bearing surfaces and durable surfaces for repeated contact with the clips, wire, and post.

The preferred tool allows the user to stand in front of the fence post and to operate the tool with little or no reaching of his hands around the post, and preferably without the need for the user to apply leverage to any portion of the tool at a significant distance from the users body, thus, reducing the potential for strain or injury. Optionally, other actuating means besides those shown may be designed to increase the ergonometric benefits of the tool.

FIGS. 1–9 show an embodiment that may be used to provide the clip sliding and crimping means, the means by which the tool receives and grips the post and the wire(s), and the means by which the stack of clips is received. Although this invention has been described above with reference to these particular means, materials and embodiments, it is to be understood that the invention is not limited to these disclosed particulars, but extends instead to all equivalents within the scope of the following claims.

I claim:

1. A fence clip installer tool for use with a vertical fence post and a generally horizontal wire, the tool comprising:

a rear assembly and a front assembly;

an opening for receiving a fence post;

means for closing the tool around the post for bracing the tool against the fence post;

a plurality of generally U-shaped clips each having a main body and two ends;

means for holding said plurality of clips;

means for pushing one clip at a time around the fence post so that the clip main body is around the post and the ends extend across a horizontal wire; and means for forcing the ends to extend generally vertically around the wire;

wherein the opening is located on a side of the tool generally midway between the front assembly and the rear assembly.

2. A fence clip installer tool for use with a generally vertical fence post and a generally horizontal fence wire near the fence post, the tool comprising:

a top, a bottom, a front end, a rear end, and first and second sides;

a front assembly and a rear assembly connected together and having an opening between them for receiving a fence post near a generally horizontal fence wire that extends across a front side of the fence post;

wherein the rear assembly has a cavity for receiving a wire clip having a main body and two ends, and the rear assembly has a slide adapted to move across the cavity to contact the wire clip and move the clip forward towards the front assembly and around a rear side of the fence post; and a crimping assembly adapted to move toward the bottom of the tool in a generally vertical plane for crimping the ends of the wire clip around the fence wire;

the tool further comprising a lever system adapted to move the rear assembly forward and also to move the slide forward at a faster rate than the rear assembly.

3. A tool as in claim 2, wherein a handle is connected to the lever system and extends forward from the tool for access by a user, and wherein a handle is connected to the crimping assembly and extends forward for access by a user.

* * * * *